US006440235B1

(12) United States Patent
Kimura et al.

(10) Patent No.: US 6,440,235 B1
(45) Date of Patent: Aug. 27, 2002

(54) METHOD OF MANUFACTURING HIGH PRODUCTIVE AND HIGH STRENGTH ROLLED H-SHAPED

(75) Inventors: Tatsumi Kimura; Fumimaru Kawabata; Keniti Amano, all of Kurashiki (JP)

(73) Assignee: Kawasaki Steel Corporation, Kobe (JP)

( * ) Notice: Subject to any disclaimer, the term of this patent is extended or adjusted under 35 U.S.C. 154(b) by 0 days.

(21) Appl. No.: 09/641,346

(22) Filed: Aug. 18, 2000

(30) Foreign Application Priority Data

Sep. 7, 1999 (JP) ..... 11-252710

(51) Int. Cl.[7] ..... C21D 7/13
(52) U.S. Cl. ..... 148/546; 148/654
(58) Field of Search ..... 148/320, 333, 148/654, 546; 424/121, 126, 127

(56) References Cited

U.S. PATENT DOCUMENTS 4,521,258 A 6/1985 Tamehiro et al.
5,421,920 A * 6/1995 Yamamoto et al. ..... 148/546
5,738,739 A 4/1998 Yamamoto et al.

FOREIGN PATENT DOCUMENTS

| | | |
|---|---|---|
| EP | 0 730 042 A1 | 9/1996 |
| EP | 0 796 921 A1 | 9/1997 |
| JP | 8-144019 | 6/1996 |
| JP | 9-310117 | 12/1997 |
| JP | 10-72620 | 3/1998 |

* cited by examiner

*Primary Examiner*—Deborah Yee
(74) *Attorney, Agent, or Firm*—Oliff & Berridge, PLC

(57) ABSTRACT

Rolled H-shapes having high strength and high toughness, and which can be produced using cheaper alloy components than conventional products and which can be manufactured with a high productivity, are disclosed. A method for manufacturing the H-shapes is also disclosed. The rolled H-shapes include 0.03 to 0.1 wt. % of Nb and 0.005 to 0.04 wt. % of Ti. The method includes a rough universal rolling process in which an accumulated reduction at a rolling temperature of 950° C. or lower is 5% or larger, and reverse operation is conducted fast; and a finishing universal rolling, in which the rolling temperature is 750° C. or higher. Preferably, in the rough universal rolling, the accumulated reduction at a rolling temperature of 950° C. or lower is 50% or more.

12 Claims, 2 Drawing Sheets

METHOD OF MANUFACTURING HIGH PRODUCTIVE AND HIGH STRENGTH ROLLED H-SHAPED

BACKGROUND OF THE INVENTION

1. Field of Invention

This invention relates to rolled H-shape steel products (H-shapes) having a small qualitative variation within each product and also having small qualitative variations between products, with each steel product having high strength and high toughness. This invention also relates to a method of manufacturing H-shapes.

2. Description of Related Art

H-shapes are used in various industrial fields, such as construction, marine structures, shipbuilding, storage tanks, civil engineering and construction machinery. For a long time, people have tried their best to improve the characteristics of H-shapes so as to obtain a higher strength and a higher toughness. Particularly, in recent years, there has been a demand for an H-shape manufactured such that its various characteristics are uniform along its thickness direction, and that the H-shape characteristics are the same from one product to another.

Further, with the development of construction techniques for high buildings, it has been reported that many construction designs are capable of absorbing vibration energy caused by deformation of a building during a large earthquake, thereby preventing the building from collapsing (see, e.g., Iron and Steel, 1988, No. 6, pp. 11–21). According to these construction designs, the skeleton (framed structure) of a building is allowed to collapse in a predetermined manner during an earthquake, thereby preventing the building itself from collapsing due to the plasticity of the materials forming the skeleton.

With the above construction designs, it is assumed that the skeleton of a building should behave in a predetermined manner, as designed by its designer, during an earthquake. Namely, it is necessary for the building designer to know the yield strength of steel materials forming each column and each beam of the building. For this reason, it is absolutely important that a steel product, such as H-shape for use in forming each column and each beam, have characteristics which are uniform within each column and beam, and which are also uniform from one product to another. In other words, severe problems will occur if an H-shape has characteristics which are not uniform within the product itself, and if the characteristics of one product are different from those of another.

However, with regard to some steel products used in civil engineering, construction and shipbuilding, these steel products should have a high strength and a high toughness. Accordingly, these steel products are usually produced by a controlled rolling and controlled cooling method, known as the Thermo Mechanical Controlled Process (TMCP method).

However, when a steel product having a thickness of about 40 mm is manufactured using the TMCP method, during the cooling process conducted after the rolling treatment, the cooling rate will be different from place to place in the thickness direction of a given steel product, and will also be different from one steel product to another. As a result, the structure of a finally obtained steel product will not be uniform everywhere within the product, and the microstructure of one steel product will be different from that of another. The material quality of each given steel product will be different from place to place in the thickness direction of the product, and the material quality of one steel product will be different from that of another.

Further, when the hardenability of each steel product is to be increased, the welding crack sensibility index, which is an index of weldability (hereinafter simply referred to as $P_{cm}$), will be undesirably increased. Namely, there has been a problem that the toughness of each welding heat-affected zone (hereinafter simply referred to as "HAZ") will deteriorate.

In the past, steels having a high tensile strength over 570 MPa were produced mainly through a process including reheating, quenching and tempering, to thereby obtain a finely tempered martensite structure. However, the process including reheating, quenching and tempering is too expensive.

In order to solve the above problem, there have been suggested improved steel products that have a small qualitative variation within each product, and also among a plurality of steel products, and that are capable of inhibiting the deterioration of the toughness of the HAZ.

Also, there have been suggested several improved processes for manufacturing the steel products. These steel products and the manufacturing processes are disclosed in Japanese Unexamined Patent Application Publication Nos. 8-144019, 9- 310117, 10-72620. The techniques disclosed in these publications all form steel structures that contain bainite as their main microstructure, irrespective of variations in their cooling rates.

Actually, the techniques disclosed in the above publications are all based on a newly discovered fact indicating that the occurrence of qualitative variation of steel products is caused by microstructural changes because of the difference in cooling rate from place to place within a piece of steel as it is being cooled. Therefore, the above-mentioned techniques have tried to solve the above-mentioned problems by preparing an improved steel composition that is useful in preventing the microstructure from changing, without having to consider any change in the cooling rate. It has been reported that the above-mentioned techniques are so established that an appropriate amount of elemental B is added into an extremely low carbon steel, or into a high Mn steel, to make it possible to obtain a microstructure containing bainite as its main component, and with its composition not depending upon the cooling rate in the cooling process, thereby obtaining steel products having little qualitative variation within each steel product and also among different steel products. Further, the above-mentioned techniques also attempt to reduce C content, so as to reduce $P_{cm}$, thereby improving the weldability of each steel product.

However, the techniques disclosed in Japanese Unexamined Patent Application Publication Nos. 8-144019, 9-310117 and 10-72620 mainly relate to H-shapes having a flange thickness of more than 50 mm, and to thick steel plates having a thickness of 50 mm or more, assuming that a heating treatment after rolling is necessary. Indeed, the above mentioned techniques are suitable for use in manufacturing H-shapes having a thinner flange thickness. However, when it is desired to improve the productivity and economics in steel manufacturing, these techniques still need to be further improved, so as to improve the composition of each steel product, and to improve some relevant manufacturing methods, thereby making it possible for each steel product to obtain a high strength and a high toughness. By virtue of such further improvement, it is possible for H-shapes having the above-described thin size to obtain a fine steel structure by rolling treatment, i.e., beneficial from a rolling refinement of the structure.

In recent years, as an earthquake proof material, H-shapes having the above-described thin size have become increasingly used. Namely, up to the present time, it has been required that H-shapes having the above-described thin size should have a further higher strength and a further higher toughness, and be manufactured at a lower cost.

SUMMARY OF THE INVENTION

It is an object of this invention to provide an improved rolled H-shape which has a large tensile strength, and a high strength and a high toughness.

It is a separate object of this invention to provide an improved method for manufacturing the improved rolled H-shape having a high productivity and a high strength, which can be produced using alloy components that are cheaper than conventional ones, so that the steel product can be manufactured at a lower cost.

Namely, embodiments of this invention provide high productive and high strength rolled H-shapes having a tensile strength of 500 to 700 MPa, and comprising: 0.014 to 0.05 wt. % of C, 0.1 to 1.0 wt. % of Si, 1.0 to 1.8 wt. % of Mn, 0.030 wt. % or less of P, 0.020 wt. % or less of S, 0.1 wt. % or less of Al, 0.0003 to 0.0040 wt. % of B, 0.006 wt. % or less of N, 0.03 to 0.1 wt. % of Nb, 0.005 to 0.04 wt. % of Ti, and the balance Fe and unavoidable impurities. Further, the high productive and high strength rolled H-shape of embodiments of this invention can further comprise from 0.0005 to 0.0100 wt. % of Ca and have flange portions with a thickness of 40 mm or less.

Further, this invention also provides a method for manufacturing the high productive and high strength rolled H-shape having, in embodiments, a tensile strength of 500 to 700 MPa. The method comprises subjecting raw steel materials to reheat treatment, and then to a break down rolling, a rough universal rolling and a finishing universal rolling, thereby obtaining the H-shape.

The raw steel materials can contain the above listed components, with the balance of Fe and unavoidable impurities. In embodiments, the reheating temperature is from 1150 to 1320° C. In embodiments, in the rough universal rolling, the accumulated reduction at a rolling temperature of 950° C. or lower is at least 5%, with each working strip being reversed fast. In embodiments, in the finishing universal rolling, the rolling temperature is 750° C. or higher. In embodiments of the method of this invention, in the rough universal rolling, the total stopping time period at the reverse operation is set to be 120 seconds or less, and the accumulated reduction at a rolling temperature of 950° C. or lower is 50% or less. Alternatively, in embodiments, the products are air cooled between the rough universal rolling and the finishing universal rolling, and after the finishing universal rolling.

DETAILED DESCRIPTION OF PREFERRED EMBODIMENTS

Figure 1:
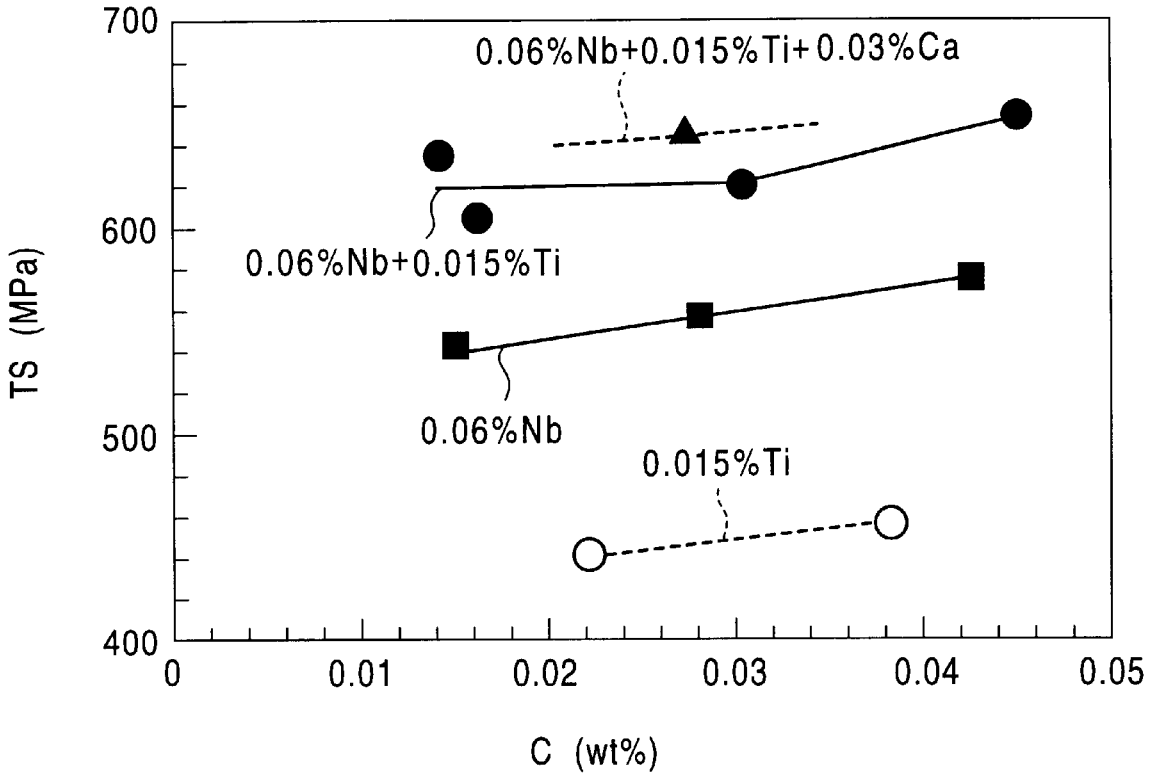
FIG. 1 is a graph showing the relationship between the tensile strength (TS) and C content, indicating the effect when only Nb is added, the effect when only Ti is added, and the effect when both Nb and Ti are added.

The inventors of this invention have repeatedly carried out researches on the composition of an H-shape and a method for manufacturing the steel product.

(1) In order to achieve a material having a large range of tensile strength which is 500 to 700 MPa, among a plurality of reinforcing components including Cr, Ni, Mo, V, Ti, Nb and Cu, the addition of Cr, Ni, Mo, V and Cu should be controlled at an amount that is as small as possible, while Ti and Nb should be both added.

(2) In a rolling process for treating the raw material components of the above material (1), if the following requirements (a) and (b) are both satisfied at the same time, it is possible to obtain a steel product that has a structure comprising mainly bainite, and having a high strength and a sufficient toughness.

(a) During rough universal rolling, the accumulated reduction at a temperature of 950° C. or lower is 5% or more.

(b) The temperature used in the finishing universal rolling is at least 750° C.

(3) In the above rolling processes, if the following requirements (c) and (d) are both satisfied at the same time, it is possible to further improve the productivity in manufacturing the H-shape.

(c) In the rough universal rolling, each working strip is reversed fast in passing.

(d) The product is air cooled between the rough universal rolling and the finishing universal rolling, and after the finishing universal rolling.

In fact, this invention has been accomplished based upon the above requirements of (1) to (3).

According to this invention, the following detailed description explains why various components contained in the H-shape of this invention are preferably within the above-mentioned ranges.

C: 0.014 to 0.05 wt. %

In order to inhibit cracking of heat affected zone (HAZ) grain boundaries, C should be contained in the steel product in an amount of at least 0.014 wt. %. If C is contained in an amount larger than 0.05 wt. %, the toughness of the base material is deteriorated, and also the weld crack sensibility becomes large, thus resulting in a deteriorated weldability. Further, because of the formation of island-like martensite, the HAZ toughness is also deteriorated. For this reason, C should be contained in the steel product in an amount that is within a range of 0.014 to 0.05 wt. %.

Si: 0.1 to 1.0 wt. %

Si is a useful element that can form solid solution in steel so as to improve the strength of steel products. In this invention, Si is added in an amount of 0.1 wt. %. If the Si content is larger than 1.0 wt. %, the HAZ toughness is deteriorated. For this reason, the Si content should be within the range of 0.1 to 1.0 wt. %.

Mn: 1.0 to 1.8 wt. %

Mn can be contained in a low C steel product so as to stably obtain a bainite structure for a steel product. In this invention, Mn is added in an amount of 1.0 wt. % or more. If Mn is added in an amount greater than 1.8 wt. %, the desired weldability is deteriorated. For this reason, Mn content should be within the range of 1.0 to 1.8 wt. %.

P: 0.030 wt. % or less

P causes segregation towards γ grain boundaries, resulting in a decrease in grain boundary strength. Accordingly, it is preferred that the addition of P should be controlled within an extremely small range. Particularly, in view of the need to ensure the HAZ toughness, an upper limit of P content should be 0.030 wt. %.

S: 0.020 wt. % or less

S reduces high temperature ductility of a steel product containing Nb and Ti and promotes surface cracking during continuous casting processes. Further, the addition of S causes the formation of MnS and also causes a decrease in the toughness of base materials. For these reasons, the upper limit of the S content is preferably 0.020 wt. %, more preferably 0.01 wt. %.

Al: 0.1 wt. % or less

Al is mainly used as a deoxidizer. However, if Al is added in an amount larger than 0.1 wt. %, it is not only impossible to obtain a further high deoxidizing effect, but such an excessive Al content also causes a deterioration in the toughness of base materials and a deterioration in the HAZ toughness. For this reason, the Al content is preferably 0.1 wt. % or less.

B: 0.0003 to 0.0040 wt. %

B can be effectively used to improve the hardenability of a steel material, so as to stably obtain a bainite structure. However, if the B content is less than 0.0003 wt. %, it is difficult to obtain a desired effect. If the B content is larger than 0.0040 wt. %, it is impossible to obtain a further improved hardenability. Also, such high B content causes a deterioration in the toughness of base materials and a deterioration in the HAZ toughness. For this reason, the B content is preferably within the range of 0.0003 to 0.0040 wt. %.

N: 0.006 wt. % or less

If the N content is too large, B will form BN, making it impossible to ensure a sufficient amount of free B. For this reason, the N content is preferably 0.006 wt. % or less.

Further, in this invention, Nb and Ti are mainly used as reinforcing elements. Nb and Ti may be used to effectively improve the strength of a steel product without undesirably influencing weldability. Further, Nb and Ti, as compared with other reinforcing elements, can provide a better strength improving effect at an extremely small addition. Consequently, Nb and Ti are desirable reinforcing elements for reducing the cost of manufacturing steel products.

Experiments were conducted to investigate how the addition of both Nb and Ti affects the strength and toughness of steel products. A method for carrying out the experiments is described as follows.

First, 0.5 wt. % of Si, 1.5 wt. % of Mn, 0.015 wt. % of P, 0.004 wt. % of S, 0.03 wt. % of Al, 0.0020 wt. % of B, 0.003 wt. % of N were prepared to be used as basic components. Then, 100 kg of steel blocks containing different amounts of C, Nb, Ti, Ca were melted to produce a steel material having a thickness of 80 mm for a laboratory experiment. The steel material was then reheated to a temperature of 1250° C., and hot rolled under a condition in which an accumulated reduction at 950° C. or lower was 20%, thereby obtaining an intermediate product having a thickness of 25 mm. The steel material was then air cooled, and cut into several pieces for use in tensile tests and Charpy tests.

Figure 2:
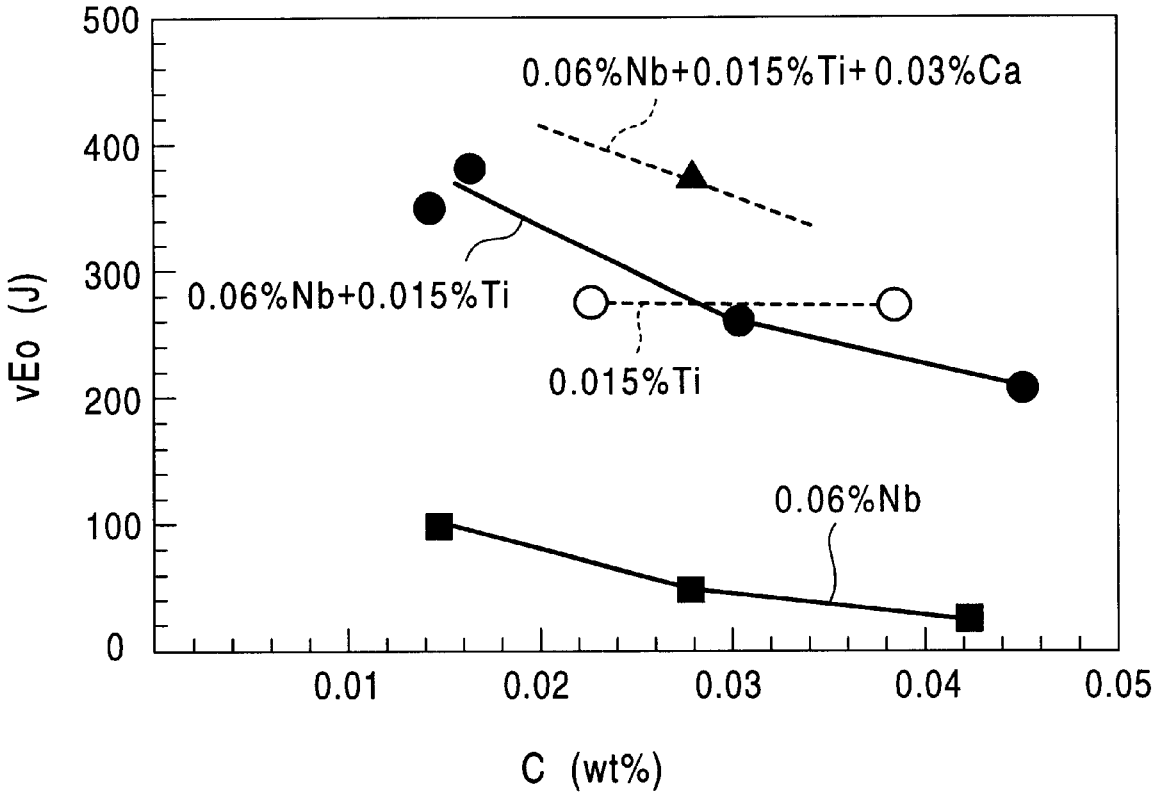
FIG. 2 is a graph showing the relationship between the toughness (vEo) and C content, indicating the effect when only Nb is added, the effect when only Ti is added, and the effect when both Nb and Ti are added.

FIGS. 1 and 2 are graphs indicating several effects on the tensile strength (TS) and the toughness (vEo) of each steel product. These effects include effects obtainable by adding both Nb and Ti, by adding only Nb, and by adding only Ti. In FIGS. 1 and 2, the symbol ○ represents the effect when only 0.015 wt. % of Ti is added, the symbol ■ represents the effect when only 0.06 wt. % of Nb is added, and the symbol ● represents the effect when both 0.015 wt. % of Ti and 0.06 wt. % of Nb are added, and the symbol Δ represents the effect when both 0.015 wt. % of Ti and 0.06 wt. % of Nb are added in addition to 0.003 wt. % of Ca. However, when the C content is less than 0.01 wt. %, cracks occur in the HAZ grain boundaries. When the C content is larger than 0.05 wt. %, the toughness of base materials is deteriorated. HAZ hardness became large, and the weldability was low.

As shown in FIGS. 1 and 2, when both Nb and Ti are added, TS and vEo can exhibit more satisfactory values as compared to when only Nb, or only Ti, is added.

Accordingly, in this invention, Nb and Ti are used as effective components for improving the strength and the toughness of steel products, and their contents are set to be within the following ranges.

Nb: 0.03 to 0.1 wt. %

Nb improves the strength of steel products by transformation strengthening. However, if the amount of Nb is less than 0.03 wt. %, the addition of Nb provides less than a completely satisfactory effect. If the Nb content is larger than 0.1 wt. %, such an excessive Nb content causes a deterioration in the toughness of base materials and a deterioration in the HAZ toughness. For this reason, the Nb content is preferably within a range of 0.03 to 0.1 wt. %.

Ti: 0.005 to 0.04 wt. %

Ti has a function of fixing N in steel materials by forming TiN, thereby making it possible to inhibit the formation of BN. As a result, the amount of free B is increased, so that it is possible for the free B to sufficiently provide a desired hardenability improving effect. Further, because Ti has another function of reducing the size of γ particles, it can also be used to improve the toughness of base materials. However, if the Ti content is less than 0.005 wt. %, such a small amount of Ti can hardly provide the desired effect. If Ti is added in an amount larger than 0.04 wt. %, the effect corresponding to such a large Ti content is not further improved. For this reason, the Ti content is preferably within a range of 0.005 to 0.04 wt. %.

Nevertheless, in view of the necessity of fixing N in steel material, it is preferred that Ti be added in an amount which is 3.4 times or more the amount of N.

There are known other elements that can also be used as reinforcing components, including Cr, Ni, Mo, V and Cu, but these elements increase the cost of manufacturing the steel product. For this reason, these elements, if added, are added preferably in amounts not exceeding the following upper limits: Cr: 0.3 wt. %, Ni: 0.2 wt. %, Mo: 0.1 wt. %, V: 0.02 wt. %, and Cu: 0.3 wt. %.

In addition to the above-listed preferred elements, Ca can be added to prevent the nozzles of a continuous casting machine from clogging. However, if Ca is added in an amount less than 0.0005 wt. %, it is difficult to obtain a completely satisfactory effect. If Ca is added in an amount larger than 0.0100 wt. %, it is difficult to obtain a sufficient cleanliness for steel products, and also the toughness of the products decrease. For this reason, when Ca is added, it is preferably added in an amount of 0.0005 to 0.0100 wt. %.

As described above, according to this invention, within the range of C content that is selected to inhibit HAZ grain boundary cracking and to improve the HAZ toughness, Mn, B, Nb and Ti are added to ensure that the hardenability of each steel product is sufficient, the steel microstructure mainly comprises a bainite structure, so that it is possible to obtain a high strength for the steel product. As a result, Cr, Ni, Mo, V and Cu are not added, or each of these elements may be added in an amount that is as small as possible, thereby making it possible to reduce the cost for the manufacturing process.

Further, by adjusting the above components to be within the ranges of the above described composition, it is possible to produce various steel products having tensile strengths that are within a range that is as large as 500 to 700 MPa. For example, adjusting the amount of Nb can change the starting temperature for the bainite transformation. As a result, it is possible to control the strength of each steel product at a desired level.

Next, the manufacturing process according to this invention is described in detail below.

An amount of molten steel having an adjusted composition is molded into raw materials for producing blooms or beam blanks, by a continuous casting method or a block making/dividing method. Then, the raw materials are hot rolled in a wide flange beam mill. During the hot rolling, the raw materials are first reheated, then subjected to break down rolling and further subjected to rough universal rolling, thereby obtaining steel products having shapes that are almost the same as those of final products. Subsequently, finishing universal rolling is conducted to further adjust the shapes of steel products.

The break down rolling is a process that is conducted by using a break down rolling mill to perform a reverse multi-pass rolling, so as to obtain rough raw materials for producing steel strips. Thus, the break down rolling is equivalent to caliber-type rolling. Here, the break down rolling mill is a two-high rolling mill including rolls each having a plurality of grooves, but which is not equipped with any intermediate rolls or back-up rolls. In view of a mill load and a rolling torque, the obtained raw materials are preferably reheated at a high temperature of 1250° C.

The rough universal rolling is a process that is conducted by a rough universal rolling mill to perform a reverse multi-pass rolling, so as to obtain a rolled steel material having a size that is almost the same as that of a final steel product. The rough universal rolling mill is a rolling mill including vertical rolls and horizontal rolls. In practice, the vertical rolls are used to roll the flange portions of each H-shape, while the horizontal rolls are used to roll the web portion thereof, with the two types of rolling being performed at the same time. This process is the most important process for rolling H-shape. By controlling the rolling process at this time, the quality of each steel product can almost be determined at this step.

The finishing universal rolling is a process corresponding to a skin pass rolling for rolling steel plate, which is usually a one-pass process for adjusting the final shape of each steel product. In practice, the finishing universal rolling mill is similar to the above rough universal rolling mill, including vertical rolls and horizontal rolls. Because the flange portions of each H-shape material are slightly curved outwardly, the finishing universal rolling is effective in making curved portions straight. The reduction at this process is about 5% for each pass.

In the above rolling processes, the temperature for reheating the raw materials needs to be within the range of 1150 to 1320° C. If the reheating temperature is lower than 1150° C., the deformation resistance is undesirably increased, hence making it difficult to ensure a desired workability, which is needed for shaping a steel material into a desired configuration. If the reheating temperature is higher than 1320° C., increased scale loss occurs, resulting in an undesired increase in reheating cost per unit product. Moreover, there is also a possibility that the initial γ particles will become large and hence the toughness of the steel product will become deteriorated. For this reason, the temperature for reheating the raw materials is preferably within the range of 1150 to 1320° C.

In the rough universal rolling, due to a temperature drop in the latter half of multi-pass rolling, the rolling temperature becomes low until it drops to 950° C., which is a temperature forming γ non-recrystallized areas. At this time, the rolling temperature is set to be equal to a surface temperature of a portion whose width is ¼ of that of a flange portion of an H-shape. In fact, regarding quality control of an H-shape, the rough universal rolling is the most important treatment if it is necessary to take into account the range of rolling temperature. If the rolling temperature is 950° C. or lower, the accumulated reduction amount is too small, hence making it difficult to obtain a desired micro-structure for the steel, and thus resulting in a decreased toughness. For this reason, it is preferred that the accumulated reduction amount at a temperature of 950° C. or lower is 5% or larger. Nevertheless, the accumulated reduction amount at a temperature of 950° C. or lower may be calculated with the use of the equation $(A-B)/A\times100$, in which A represents a gap length between rolls before a rolling pass at a temperature of 950° C. or lower, and B represents a gap length between rolls at a final pass.

In fact, a larger accumulated reduction amount at a temperature of 950° C. or lower is effective for the base materials to obtain a higher strength and a higher toughness. Accordingly, such a larger accumulated reduction amount is desirable. However, with regard to certain rolling sizes, there is a possibility that the rolling has to be postponed until the temperature becomes 950° C. or lower, which is the temperature forming γ non-recrystallized areas. Nevertheless, if the rolling is postponed for too long of a time, the productivity becomes low. Further, because there is no heat maintaining equipment in a place where the rolling is postponed, if the rolling is delayed for too long of a time, a temperature difference occurs and will be enlarged between the web portion and the flange portions due to their different thicknesses. Usually, because the web portion of an H-shape is thin, the web portion has a lower temperature than that of each flange portion. When the temperature difference between the web portion and the flange portions is enlarged, the web portion is likely to deform, hence making it difficult to obtain a high yield in the manufacturing process. For this reason, in order to obtain a high productivity, it is required that when the rough universal rolling is carried out, the rolling is not postponed and the reverse operation is completed in a short amount of time. Preferably, during the rough universal rolling, the total stopping time of the rolled steel material at reverse operation during rolling is controlled within 120 seconds. Accordingly, during the rough universal rolling, it is preferred that an accumulated reduction amount at a temperature of 950° C. or lower be set at 50% or lower.

The finishing universal rolling is performed at a temperature of 750° C. or higher. If the rolling temperature is lower than 750° C., the surface quality of an H-shapes becomes deteriorated (for example, surface defects occur), and so also is the shape quality of steel products (as the right angle degree is not sufficiently correct).

Further, the cooling process carried out between the rough universal rolling and the finishing universal rolling, and the cooling process carried out after the finishing universal rolling, is preferably an air cooling treatment. Moreover, for preventing the enlargement of the temperature difference between the web portion and the flange portions of each H-shape, the water cooling treatment can be carried out to cool the flange portions, serving as a step between the rough universal rolling and the finishing universal rolling. Alternatively, the water cooling treatment can be carried out after the finishing universal rolling. However, when the water cooling system is used, it is difficult to ensure uniform temperatures on the left and right sides of each H-shape. As a result, curvature and warpage occur in the rolling direction, causing problems in passing each steel product through a rolling mill, hence reducing a desired productivity. Namely, when the flange portions of each H-shape are cooled, it is important to control the cooling temperature. For this reason, the cooling process conducted between the rough rolling and the finishing rolling, and the cooling process performed after the finishing rolling, are preferably air cooling processes.

Although the size of the H-shape manufactured according to the above-described method is not limited, it is preferred that the thicknesses of the flange portions of each H-shape be set at 40 mm or less. The reason for this preferred thickness is described below.

Namely, if a steel product or an H-shape has a flange with thickness larger than 40 mm, the total reduction amount at rolling is reduced and the cooling rate is lowered only because of an increase in such thickness. As a result, it is necessary to compensate for a decrease in its strength and a decrease in its toughness, which are caused due to the reduction in the total reduction amount and due to the reduction in the cooling rate. In other words, it is necessary to design some corresponding components and consider specific rolling and cooling processes, which are usually involved in known processes.

EXAMPLES

Steel materials having compositions as shown in TABLE 1 below were treated under various conditions shown in TABLE 2 below, thereby producing various H-shapes. Productivity can be decided by comprehensively taking into account the number of tons for rolling per hour, rolling size, the time interval between every two rolling for rolling two serial steel products, and the number of rolling passes.

Various H-shapes obtained in the above described method were examined by taking JIS No. 4 tension test pieces and JIS No. 4 impact test pieces from a portion which is ¼ of a flange width and a portion which is ¼ of a flange thickness, with the taking direction being parallel with the rolling direction. In this way, the mechanical properties of each H-shape were investigated.

Next, in order to evaluate the HAZ toughness of each H-shape, a reproduction heat cycle test piece was taken from a portion which is ¼ of a flange thickness, thereby performing a heat cycle treatment to simulate the HAZ. Then, a Charpy test piece was taken to measure Charpy absorption energy at a temperature of 0° C. Here, the heat cycle includes (1) heating a steel product to a temperature of 1400° C., (2) cooling the steel product to reduce its temperature from 800° C. to 500° C. within 300 seconds. Then, subsequent to (1) and (2), a reheating treatment was performed until the steel product reaches a temperature of 700° C., which is below the $A_{r1}$ point. Here, (1) corresponds to a heat cycle added in a welding section (hereinafter simply referred to as a "BOND section") when a welding is carried out with an added heat amount of 500 kJ/cm, and (2) corresponds to a heat cycle added in a reheated BOND section when a welding is carried out with an added heat amount of 500 kJ/cm.

The results obtained in the above experiment are shown in TABLE 3 below.

TABLE 1

| Steel | Composition (wt %) | | | | | | | | | | | | | |
|---|---|---|---|---|---|---|---|---|---|---|---|---|---|---|
| Product | C | Si | Mn | P | S | Al | B | N | Nb | Ti | Ca | Others | Ti/N | Remarks |
| A | 0.015 | 0.43 | 1.33 | 0.015 | 0.003 | 0.031 | 0.0018 | 0.0040 | 0.078 | 0.015 | | | 3.8 | Inventive Example |
| B | 0.030 | 0.53 | 1.50 | 0.015 | 0.003 | 0.030 | 0.0025 | 0.0040 | 0.052 | 0.014 | | | 3.6 | Inventive Example |
| C | 0.045 | 0.52 | 1.55 | 0.011 | 0.004 | 0.033 | 0.0020 | 0.0033 | 0.049 | 0.012 | | | 3.6 | Inventive Example |
| D | 0.038 | 0.52 | 1.59 | 0.008 | 0.002 | 0.038 | 0.0021 | 0.0030 | 0.051 | 0.015 | 0.0028 | | 5.0 | Inventive Example |
| E | 0.030 | 0.28 | 1.07 | 0.010 | 0.003 | 0.041 | 0.0015 | 0.0048 | 0.038 | 0.019 | | | 4.0 | Inventive Example |
| F | 0.025 | 0.40 | 1.48 | 0.015 | 0.005 | 0.030 | 0.0021 | 0.0045 | 0.045 | 0.016 | | Cr: 0.29 | 3.6 | Inventive Example |
| G | 0.046 | 0.33 | 1.52 | 0.010 | 0.003 | 0.048 | 0.0020 | 0.0050 | 0.050 | 0.022 | | Cu: 0.28 | 4.4 | Inventive Example |
| H | 0.018 | 0.52 | 1.42 | 0.012 | 0.002 | 0.022 | 0.0023 | 0.0036 | 0.040 | 0.015 | | Mo: 0.08 | 4.2 | Inventive Example |
| I | 0.026 | 0.43 | 1.53 | 0.018 | 0.005 | 0.032 | 0.0018 | 0.0031 | 0.043 | 0.015 | | Ni: 0.18, V: 0.02 | 4.8 | Inventive Example |
| J | 0.033 | 0.22 | 1.44 | 0.009 | 0.002 | 0.030 | 0.0013 | 0.0055 | 0.035 | 0.024 | | Cr: 0.20, Ni: 0.15, Cu: 0.24 | 4.4 | Inventive Example |
| K | 0.006 | 0.48 | 1.55 | 0.008 | 0.002 | 0.030 | 0.0020 | 0.0038 | 0.068 | 0.015 | | | 3.9 | Comparative Example |
| L | 0.030 | 0.55 | 1.53 | 0.012 | 0.003 | 0.027 | 0.0023 | 0.0028 | 0.055 | | | | 0 | Comparative Example |
| M | 0.024 | 0.51 | 1.58 | 0.010 | 0.004 | 0.028 | 0.0015 | 0.0041 | | 0.015 | | | 3.7 | Comparative Example |
| N | 0.031 | 0.51 | 1.55 | 0.012 | 0.006 | 0.031 | 0.0012 | 0.0078 | 0.083 | 0.008 | | | 1.0 | Comparative Example |
| O | 0.025 | 0.41 | 1.50 | 0.012 | 0.003 | 0.035 | 0.0018 | 0.0050 | 0.12 | 0.020 | | | 4.0 | Comparative Example |
| P | 0.063 | 0.55 | 1.51 | 0.010 | 0.003 | 0.040 | 0.0020 | 0.0038 | 0.059 | 0.014 | | | 3.7 | Comparative Example |
| Q | 0.036 | 0.51 | 1.56 | 0.016 | 0.003 | 0.002 | 0.0026 | 0.0058 | 0.058 | 0.024 | 0.0038 | | 4.1 | Inventive Example |

TABLE 2

| No. | Steel Product | Size of H-shape: Web height (mm) | Flange width (mm) | Web thickness (mm) | Flange thickness (mm) | Re-heating temperature (° C.) | Accumulated reduction at a temperature of 900° C. or lower (%) | Total stopping time of reverse operation during rolling (s) | Final rolling temperature (° C.) | Cooling condition | Remarks |
|---|---|---|---|---|---|---|---|---|---|---|---|
| 1 | A | 305 | 305 | 25 | 25 | 1230 | 25 | 48 | 880 | Air | Inventive |
| 2 | B | 305 | 305 | 25 | 25 | 1250 | 13 | 62 | 900 | Air | Inventive |
| 3 | B | 305 | 305 | 25 | 25 | 1250 | 45 | 113 | 830 | Air | Inventive |
| 4 | C | 250 | 250 | 14 | 14 | 1270 | 45 | 62 | 830 | Air | Inventive |
| 5 | C | 305 | 305 | 30 | 30 | 1220 | 25 | 51 | 900 | Air | Inventive |
| 6 | D | 305 | 305 | 25 | 25 | 1230 | 25 | 55 | 900 | Air | Inventive |
| 7 | D | 305 | 305 | 18 | 18 | 1250 | 43 | 44 | 850 | Air | Inventive |
| 8 | D | 305 | 305 | 30 | 30 | 1250 | 12 | 43 | 920 | Air | Inventive |
| 9 | E | 600 | 300 | 12 | 20 | 1270 | 15 | 53 | 920 | Air | Inventive |
| 10 | F | 900 | 300 | 16 | 28 | 1300 | 30 | 71 | 880 | Air | Inventive |
| 11 | G | 450 | 200 | 9 | 14 | 1320 | 45 | 66 | 810 | Air | Inventive |
| 12 | H | 600 | 300 | 12 | 20 | 1250 | 20 | 28 | 900 | Air | Inventive |
| 13 | I | 305 | 305 | 25 | 25 | 1250 | 25 | 44 | 900 | Air | Inventive |
| 14 | J | 305 | 305 | 30 | 30 | 1220 | 12 | 109 | 920 | Arr | Inventive |
| 15 | K | 305 | 305 | 25 | 25 | 1250 | 25 | 50 | 880 | Air | Comparative |
| 16 | L | 305 | 305 | 25 | 25 | 1230 | 25 | 39 | 900 | Air | Comparative |
| 17 | M | 305 | 305 | 25 | 25 | 1220 | 25 | 48 | 910 | Air | Comparative |
| 18 | N | 305 | 305 | 25 | 25 | 1250 | 13 | 55 | 900 | Air | Comparative |
| 19 | O | 305 | 305 | 25 | 25 | 1250 | 25 | 51 | 890 | Air | Comparative |
| 20 | P | 305 | 305 | 25 | 25 | 1250 | 60 | 250 | 760 | Air | Comparative |
| 21 | Q | 305 | 305 | 25 | 25 | 1280 | 25 | 55 | 900 | Air | Comparative |

TABLE 3

| No. | Y.S. (MPa) | T.S. (MPa) | YR (%) | $VE_o$ (J) | BOND section $vE_o$ (J) | Reheated BOND section $vE_o$ (J) | Maximum hardness* (Hv) | Productivity | Remarks |
|---|---|---|---|---|---|---|---|---|---|
| 1 | 533 | 670 | 80 | 221 | 306 | 228 | 268 | high | Inventive Example |
| 2 | 486 | 623 | 78 | 265 | 311 | 250 | 281 | high | Inventive Example |
| 3 | 509 | 621 | 82 | 315 | 311 | 216 | 281 | medium | Inventive Example |
| 4 | 489 | 639 | 77 | 398 | 300 | 289 | 286 | high | Inventive Example |
| 5 | 461 | 633 | 73 | 200 | 300 | 166 | 286 | high | Inventive Example |
| 6 | 498 | 622 | 80 | 306 | 257 | 222 | 279 | high | Inventive Example |
| 7 | 506 | 631 | 80 | 344 | 257 | 246 | 279 | high | Inventive Example |
| 8 | 453 | 618 | 73 | 213 | 257 | 162 | 279 | high | Inventive Example |
| 9 | 509 | 640 | 80 | 189 | 229 | 150 | 276 | high | Inventive Example |
| 10 | 440 | 640 | 69 | 336 | 306 | 187 | 277 | high | Inventive Example |
| 11 | 530 | 662 | 80 | 443 | 268 | 136 | 285 | high | Inventive Example |
| 12 | 438 | 563 | 78 | 286 | 339 | 150 | 268 | high | Inventive Example |
| 13 | 447 | 588 | 76 | 423 | 352 | 258 | 275 | high | Inventive Example |
| 14 | 530 | 689 | 77 | 209 | 227 | 131 | 280 | medium | Inventive Example |
| 15 | 536 | 630 | 85 | 254 | 15 | 156 | 243 | high | Comparative Example |
| 16 | 416 | 516 | 81 | 40 | 70 | 88 | 290 | high | Comparative Example |
| 17 | 331 | 426 | 78 | 228 | 276 | 290 | 286 | high | Comparative Example |
| 18 | 348 | 493 | 71 | 400 | 316 | 278 | 294 | high | Comparative Example |
| 19 | 598 | 698 | 86 | 21 | 7 | 13 | 280 | high | Comparative Example |

TABLE 3-continued

| No. | Y.S. (MPa) | T.S. (MPa) | YR (%) | $VE_o$ (J) | BOND section $vE_o$ (J) | Reheated BOND section $vE_o$ (J) | Maximum hardness* (Hv) | Productivity | Remarks |
|---|---|---|---|---|---|---|---|---|---|
| 20 | 500 | 628 | 80 | 153 | 73 | 93 | 343 | low | Comparative Example |
| 21 | 510 | 624 | 82 | 224 | 277 | 206 | 288 | high | Inventive Example |

*Bead length of maximum hardness test = 20 mm

As may be understood from TABLE 3, each of the H-shapes obtained in Examples according to this invention has a good productivity, a high tensile strength which is 500 MPa or higher, an excellent toughness of the BOND section, and an excellent toughness of the reheated BOND section. Further, an investigation was made into the hardness of each H-shape in the thickness direction of its flange portions and its web portion. As a result, it was found that the hardness of one steel product differs by only a very small amount from that of another, thereby exhibiting a uniform hardness distribution.

In contrast to the Examples according to this invention, a plurality of Comparative Examples (steel K and steel P), in which the C content is not in the range of this invention, indicate that the toughness of BOND sections are low and their hardness are extremely higher. Namely, some problems still exist relating to the toughness and the weldability of the HAZ. Further, with regard to a steel L not containing Ti, a steel M not containing Nb, and a steel N containing a large amount of N, it is found that both their strength and toughness are deteriorated. Moreover, with the steel O having a Nb content above its upper limit, the toughness of both the base material and HAZ are deteriorated.

Accordingly, with this invention, it is possible to produce, at an extremely low cost and with an extremely high productivity, rolled H-shapes having substantially no quality variations, or even no quality variations, within each steel product, and having material qualities that are not substantially different, or that are even not different at all, from one steel product to another, thereby providing improved H-shapes each having a higher strength and a higher toughness than conventional H-shapes, and further having an excellent weldability.

What is claimed is:

1. A method of manufacturing a rolled H-shape comprising:

reheating a molded raw steel material to a temperature of from 1150° C. to 1320° C.;

then subjecting the molded raw steel material to a break down rolling comprising performing a reverse multi-pass rolling to obtain rough raw material for steel strip, a rough universal rolling comprising performing reverse multi-pass rolling to obtain a rolled steel material, and a finishing rolling comprising adjusting the final shape of the H-shape, the raw steel material comprising:

C: 0.014 to 0.05wt. %,

Si: 0.1 to 1.0 wt. %,

Mn: 1.0 to 1.8 wt. %,

P: 0.030 or less,

S: 0.020 wt. % or less,

Al: 0.1 wt. % or less,

B: 0.0003 to 0.0040 wt. %,

N: 0.006 wt. % or less,

Nb: 0.03 to 0.1 wt. %,

Ti: 0.005 to 0.04 wt. %, and the balance of Fe and unavoidable impurities;

wherein, in the rough universal rolling, an accumulated reduction at a rolling temperature of 950° C. or lower is 5% or more, and the rolled steel material is reversed fast;

wherein, in the finishing universal rolling, the rolling temperature is at least 750° C.; and wherein the H-shape comprises flange portions which each have a thickness of 40 mm or less.

2. The method of manufacturing the rolled H-shaped according to claim 1, wherein in the rough universal rolling, a total stopping time period during reverse rolling is 120 seconds or less.

3. The method of manufacturing the rolled H-shape according to claim 2, wherein in the rough universal rolling, the accumulated reduction at a rolling temperature of 950° C. or lower is 50% or less.

4. The method of manufacturing the rolled H-shape according to claim 1, wherein the molded raw steel material is air cooled between the rough universal rolling and the finishing universal rolling, and after the finishing universal rolling.

5. The method of manufacturing the rolled H-shape according to claim 2, wherein the molded raw steel material is air cooled between the rough universal rolling and the finishing universal rolling, and after the finishing universal rolling.

6. The method of manufacturing the rolled H-shape according to claim 3, wherein the molded raw steel material is air cooled between the rough universal rolling and the finishing universal rolling, and after the finishing universal rolling.

7. The method of manufacturing the rolled H-shape according to claim 1, wherein the raw steel material further comprises 0.0005 to 0.0100 wt. % of Ca.

8. The method of manufacturing the rolled H-shape according to claim 2, wherein the raw steel material further comprises 0.0005 to 0.0100 wt. % of Ca.

9. The method of manufacturing the rolled H-shape according to claim 3, wherein the raw steel material further comprises 0.0005 to 0.0100 wt. % of Ca.

10. The method of manufacturing the rolled H-shape according to claim 4, wherein the raw steel material further comprises 0.0005 to 0.0100 wt. % of Ca.

11. The method of manufacturing the rolled H-shape according to claim 1, wherein the raw steel material comprises more than 0.025 to 0.05 wt. % of C.

12. The method of manufacturing the rolled H-shape according to claim 1, wherein the raw steel material comprises 0.1 wt. % or less of Mo.

* * * * *